US008495957B2

(12) United States Patent
Kato

(10) Patent No.: US 8,495,957 B2
(45) Date of Patent: Jul. 30, 2013

(54) IMAGE-FORMING MACHINE HAVING SPEED PRIORITY SETTING BASED ON SHEET TRAVELING ROUTES

(75) Inventor: Kazuhiro Kato, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 919 days.

(21) Appl. No.: 12/149,547

(22) Filed: May 5, 2008

(65) Prior Publication Data

US 2008/0292328 A1 Nov. 27, 2008

(30) Foreign Application Priority Data

May 21, 2007 (JP) ..... 2007-134328

(51) Int. Cl.
*B65H 3/44* (2006.01)

(52) U.S. Cl.
USPC ..... 101/118; 271/9.05; 399/388

(58) Field of Classification Search
USPC ..... 101/116, 118; 399/16, 23, 388, 391, 399/392; 271/9.01, 9.05, 9.06
See application file for complete search history.

(56) References Cited

U.S. PATENT DOCUMENTS 5,271,614 A * 12/1993 Yamada et al. ..... 271/9.06
5,420,669 A * 5/1995 Imada ..... 399/16
7,770,880 B2 * 8/2010 Yamazaki ..... 271/9.05
2006/0075909 A1 * 4/2006 Hoshi et al. ..... 101/114
2006/0250636 A1 * 11/2006 Richards ..... 358/1.15
2009/0160117 A1 * 6/2009 Negishi ..... 271/3.14

FOREIGN PATENT DOCUMENTS

JP H01-236151 A 9/1989
JP H06-024606 2/1994
JP H08-225241 9/1996
JP 2003-122071 4/2003
JP 2005-060040 3/2005

OTHER PUBLICATIONS

Japan Patent Office, "Office Action for JP 2007-134328", Nov. 27, 2012.

* cited by examiner

*Primary Examiner* — Leslie J Evanisko
(74) *Attorney, Agent, or Firm* — Manabu Kanesaka

(57) ABSTRACT

An object of the present invention is, in an image-forming machine equipped with plural paper feeders that feed paper to a drum unit at different paper feed speeds due to the difference in the shapes of paper traveling routes, to control the image-forming machine so as to select a paper feeder suitable for the condition of printing-speed-priority. A stencil printing machine has three paper feeders; a paper feed table, a first tray, and a second tray. The maximum allowable printing speeds to a drum unit of the three paper feeders: differ from each other in accordance with the difference in the shapes of traveling routes; increase in the order of the paper feed table, the first tray, and then the second tray; and are stored as data. When a user carries out printing at the setting of speed-priority, a control unit of the machine and a paper feeder selection device select the paper feeder of the highest maximum allowable image-forming speed and carry out the printing.

4 Claims, 7 Drawing Sheets

| PAPER FEEDER | PAPER FEED TABLE | NO.1 TRAY | NO.2 TRAY |
|---|---|---|---|
| MAXIMUM ALLOWABLE PRINTING SPEED | 180rpm | 100rpm | 130rpm |

Fig.5

*Fig. 6*

| NAME OF PAPER FEED TRAY | PAPER FEED TRAY(1) | PAPER FEED TRAY(2) | PAPER FEED TRAY(3) | PAPER FEED TRAY(4) |
|---|---|---|---|---|
| MAXIMUM SPEED | 180rpm | 150rpm | 120rpm | 100rpm |
| JAMMING RATE | 0.5% | 0.3% | 0.2% | 0.1% |
| SELECTABILITY | ○ | ○ | ○ | × |

*Fig. 7*

| NAME OF PAPER FEED TRAY | PAPER FEED TRAY(1) | PAPER FEED TRAY(2) | PAPER FEED TRAY(3) | PAPER FEED TRAY(4) |
|---|---|---|---|---|
| MAXIMUM SPEED | 180rpm | 150rpm | 120rpm | 100rpm |
| JAMMING RATE | 0.2% | 0.2% | 0.2% | 0.1% |
| SELECTABILITY | ○ | ○ | ○ | × |

IMAGE-FORMING MACHINE HAVING SPEED PRIORITY SETTING BASED ON SHEET TRAVELING ROUTES

FIELD OF THE INVENTION

The present invention relates to an image-forming machine that has plural image-forming paper feeders such as paper feed trays, paper feed tables, and others, and can select a paper feeder most suitable for a required image-forming speed.

BACKGROUND OF THE INVENTION

An image-forming machine having plural image-forming paper feeders such as paper feed trays, paper feed tables, and others is known. As shown in JP-A No. 1994-24606, when such an image-forming machine has plural paper trays containing an identical size of paper, the machine can be configured so as to select a paper tray of the lowest jamming rate.

In an image-forming machine, an image-forming speed at an image-forming section has to match the feed speed of paper fed from a paper feeder to the image-forming section. Here, the feed speed of paper fed from a paper feeder to the image-forming section: depends on the shape of a paper traveling route formed between the paper feeder and the image-forming section; can be increased when the traveling route is straight; and, instead, has to be reduced by as much as a curved portion of a large curvature when the portion exists.

In the case of an image-forming machine having a relatively slow image-forming speed, it is not necessary to care about the shape of a traveling route connecting a paper feeder to an image-forming section or to take a paper feed speed as the criterion for selecting one from among plural paper feeders. Then for example, a method for selecting a paper feeder on the basis of a jamming rate like the invention described in JP-A No. 1994-24606, a method for detecting the amounts of remaining paper and selecting a paper feeder having a larger amount of remaining paper, or a method for selecting a paper feeder equally so as to average the wear of consumable supplies in the paper feeders can be used.

In the case of such an image-forming machine as a stencil printing machine that allows high speed printing for example, however, a paper feeder is required to have a high paper feed speed that can conform to the printing speed in order to exhibit a high speed printing performance and thus the paper feed speed of each paper feeder determined by the position of the paper feeder and the shape of the traveling route cannot be ignored.

In view of the above situation, an object of the present invention is, in an image-forming machine equipped with plural paper feeders that feed paper to an image-forming section at different paper feed speeds in proportion to the difference of the shapes of paper traveling routes and the like, to control the image-forming machine so as to be able to select a paper feeder suitable for conditions, such as the improvement of a printing speed, required by users.

SUMMARY OF THE INVENTION

According to a first aspect of the present invention, an image-forming machine having plural paper feeders is characterized by being provided with paper feeder selection means to select a paper feeder on the basis of a maximum allowable image-forming speed set for each of the paper feeders.

According to a second aspect of the present invention, an image-forming machine described in the first aspect is characterized in that the paper feeder selection means selects the paper feeder of the highest maximum allowable image-forming speed when a user carries out image forming with the setting of speed-priority.

According to a third aspect of the present invention, an image-forming machine described in the second aspect is characterized in that the paper feeder selection means selects the paper feeder of the lowest jamming rate when the maximum allowable image-forming speeds of the plural paper feeders are identical.

According to a fourth aspect of the present invention, an image-forming machine described in the first aspect is characterized in that the paper feeder selection means selects the paper feeder of the highest maximum allowable image-forming speed in the paper feeders having maximum allowable image-forming speeds not lower than a prescribed image-forming speed when the image-forming speed is restricted to a level not higher than the prescribed image-forming speed through the image-forming conditions selected by a user and a paper feeder having a maximum allowable image-forming speed not lower than the prescribed image-forming speed exists.

According to a fifth aspect of the present invention, an image-forming machine described in the first aspect is characterized in that the paper feeder selection means selects the paper feeder of the lowest jamming rate in the paper feeders having maximum allowable image-forming speeds not lower than a prescribed image-forming speed when the image-forming speed is restricted to a level not higher than the prescribed image-forming speed through the image-forming conditions selected by a user and a paper feeder having a maximum allowable image-forming speed not lower than the prescribed image-forming speed exists.

With an image-forming machine having plural paper feeders according to the first aspect, it is possible to select a paper feeder on the basis of a maximum allowable image-forming speed set for each of the paper feeders.

With an image-forming machine according to the second aspect, in the effect of the first aspect, a paper feeder to be used is selected from among the plural paper feeders on the basis of the respective maximum allowable printing speeds intrinsic to the paper feeders and hence it is possible to efficiently select a paper feeder most suitable for a printing speed when a user gives priority to the printing speed.

With an image-forming machine according to the third aspect, in the effect of the second aspect, the paper feeder of the lowest jamming rate is selected when the maximum allowable image-forming speeds of the plural paper feeders are identical and hence not only the allowable image-forming speed of a paper feeder matches the printing speed but also it is possible to suppress the jamming rate to a low level.

With an image-forming machine according to the fourth aspect, in the effect of the first aspect, the paper feeder of the highest maximum allowable image-forming speed is selected in the paper feeders having maximum allowable image-forming speeds not lower than a prescribed image-forming speed when the image-forming speed is restricted to a level not higher than the prescribed image-forming speed through the image-forming conditions selected by a user and a paper feeder having a maximum allowable image-forming speed not lower than the prescribed image-forming speed exists.

With an image-forming machine according to the fifth aspect, in the effect of the first aspect, the paper feeder of the lowest jamming rate is selected in the paper feeders having maximum allowable image-forming speeds not lower than a prescribed image-forming speed when the image-forming speed is restricted to a level not higher than the prescribed image-forming speed through the image-forming conditions selected by a user and a paper feeder having a maximum allowable image-forming speed not lower than the prescribed image-forming speed exists.

BRIEF DESCRIPTION OF THE DRAWINGS

FIG. 5 is a table showing maximum allowable printing speeds of a stencil printing machine according to the first embodiment.

FIG. 6 is a table showing the maximum speeds, the jamming rates, and the selectability of paper feeders installed in a stencil printing machine according to the third embodiment.

FIG. 7 is a table showing the maximum speeds, the jamming rates, and the selectability of paper feeders installed in a stencil printing machine according to the fourth embodiment.

DETAILED DESCRIPTION OF THE PREFERRED EMBODIMENTS

Figure 1A:
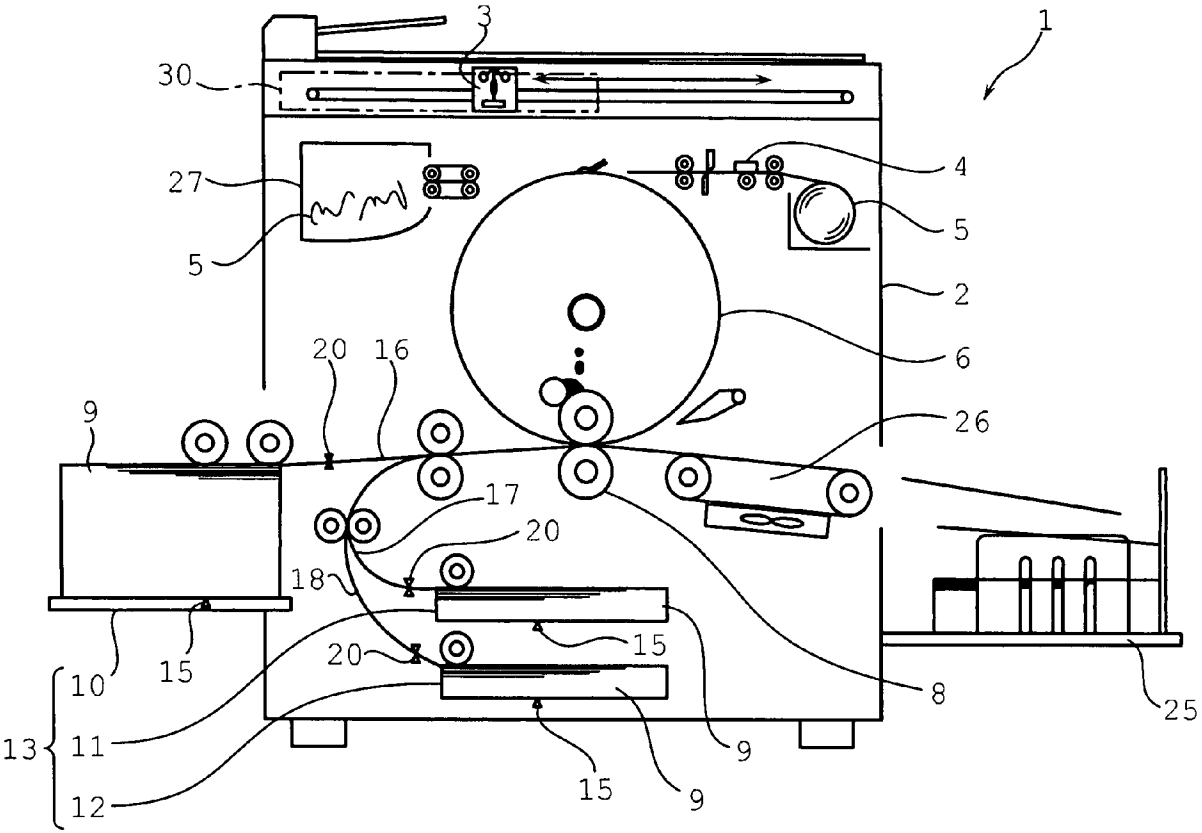
FIG. 1A is a general configuration view of a stencil printing machine according to the first embodiment.
Figure 1B:
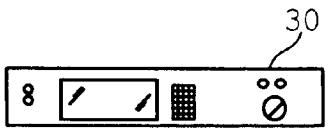
FIG. 1B is a front view of an operation panel.
Figure 2:
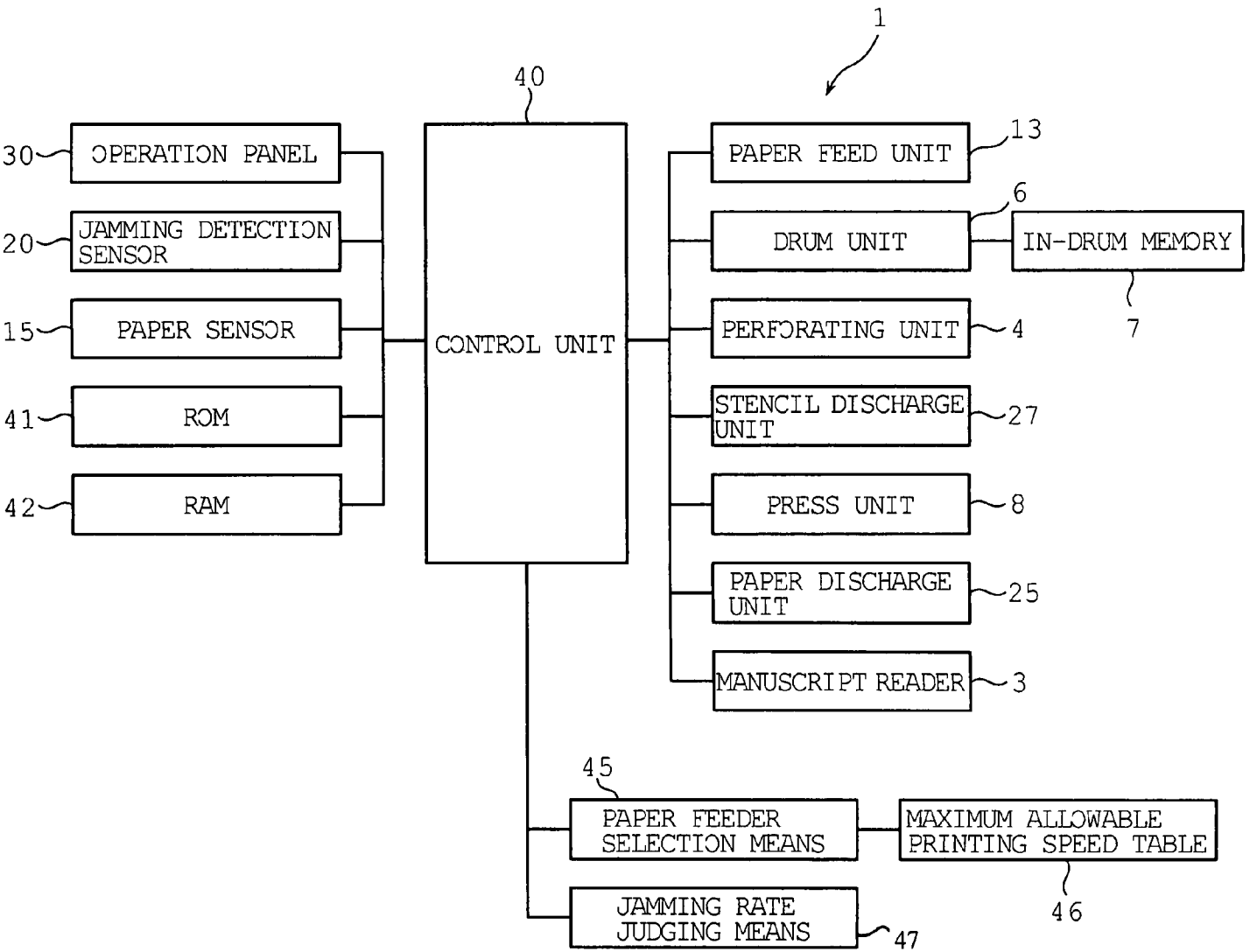
FIG. 2 is a block diagram of a stencil printing machine according to the first embodiment.
Figure 3:
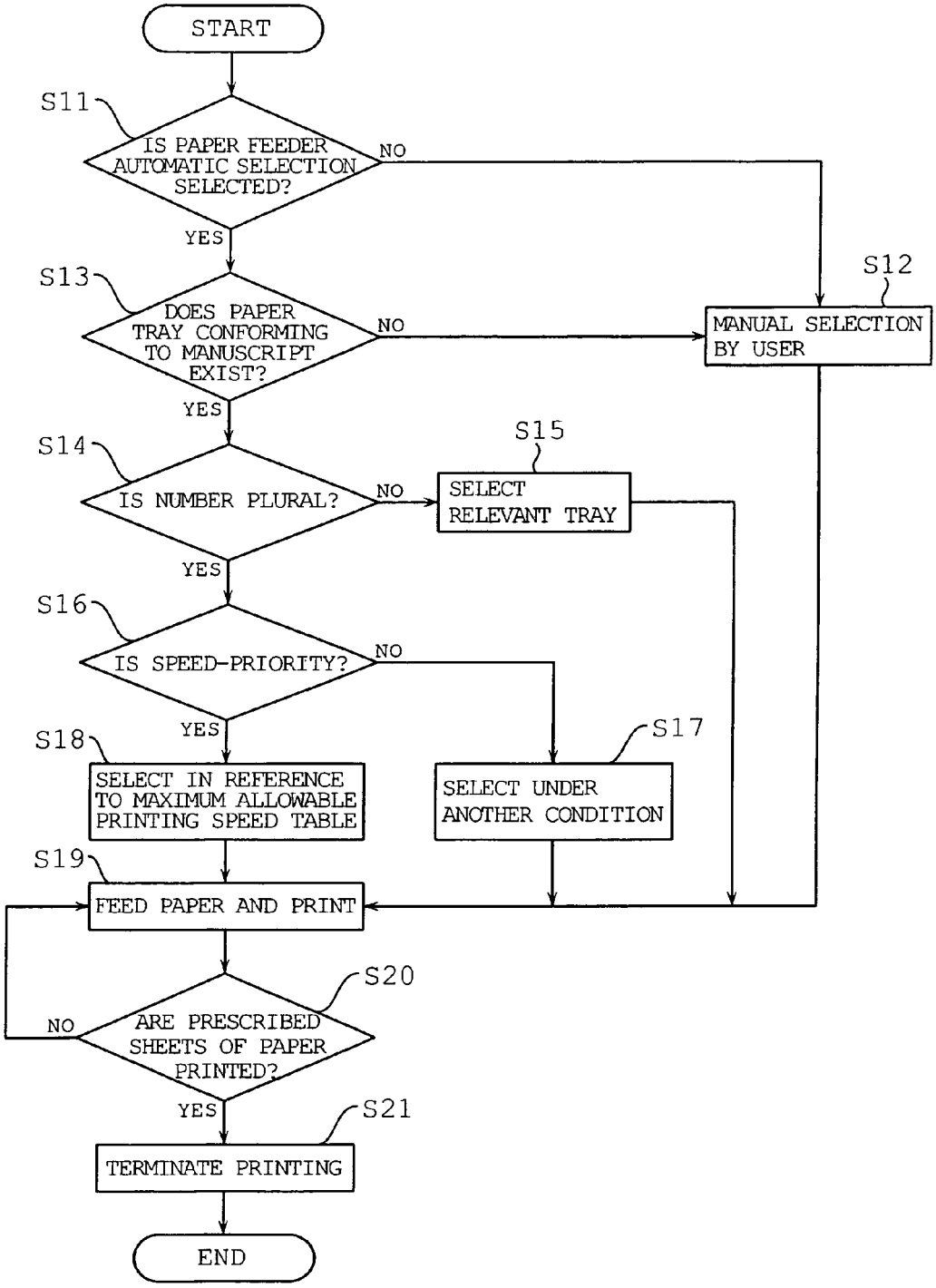
FIG. 3 is a flowchart showing the functions of a stencil printing machine according to the first embodiment.
Figure 4:
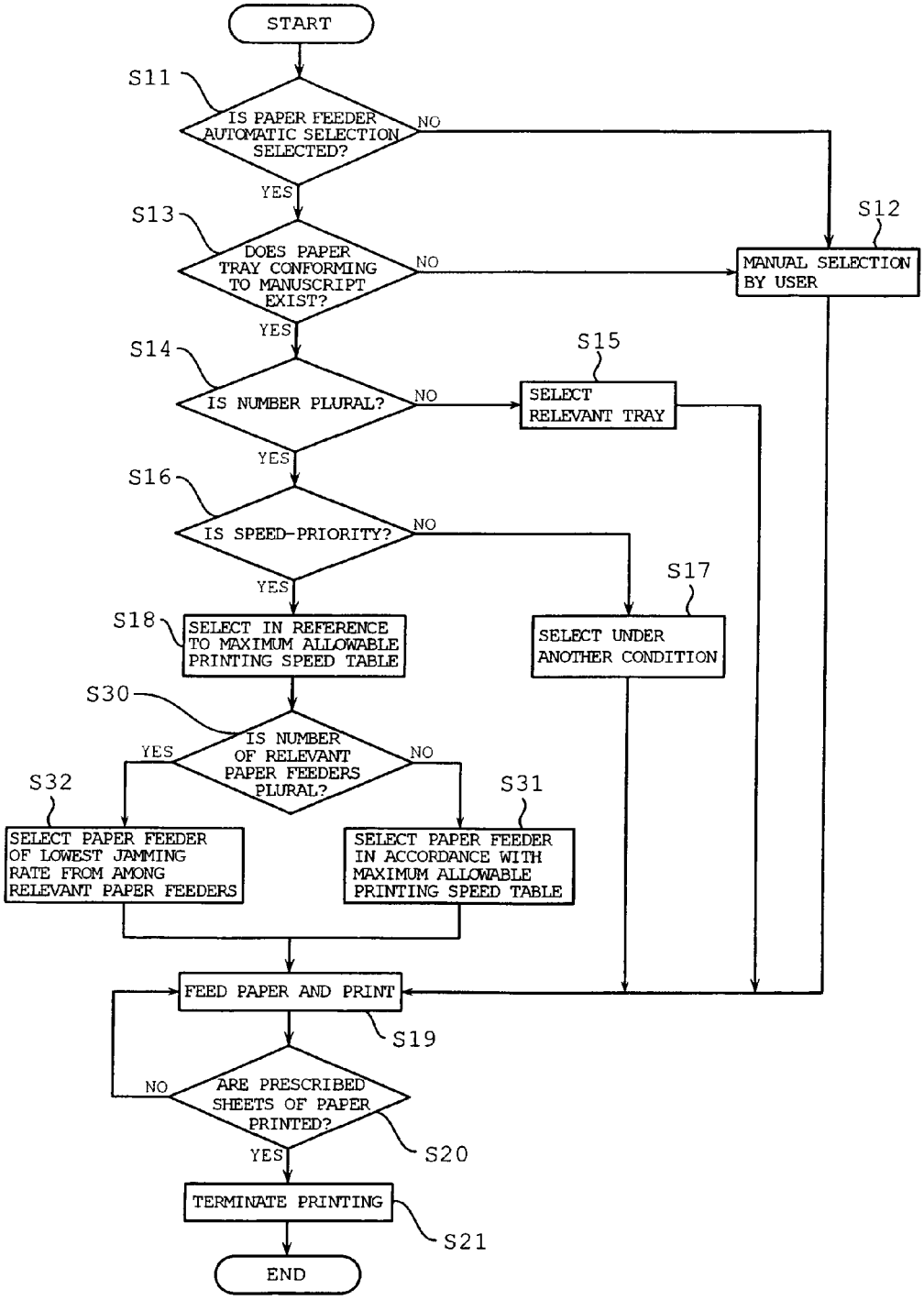
FIG. 4 is a flowchart showing the functions of a stencil printing machine according to the second embodiment.

FIG. 1A is a general configuration view of a stencil printing machine according to the first embodiment; FIG. 1B is a front view of an operation panel; FIG. 2 is a block diagram of a stencil printing machine according to the first embodiment; FIG. 3 is a flowchart showing the functions of a stencil printing machine according to the first embodiment; FIG. 4 is a flowchart showing the functions of a stencil printing machine according to the second embodiment; FIG. 5 is a table showing maximum allowable printing speeds of a stencil printing machine according to the first embodiment; FIG. 6 is a table showing the maximum speeds, the jamming rates, and the selectability of paper feeders installed in a stencil printing machine according to the third embodiment; and FIG. 7 is a table showing the maximum speeds, the jamming rates, and the selectability of paper feeders installed in a stencil printing machine according to the fourth embodiment.

As shown in FIGS. 1A, 1B, and 2, a stencil printing machine 1 of the present embodiment as one of the embodiments according to the present invention has a casing 2 as the main body and is equipped with various components that are explained below. That is, a manuscript reader 3 can read a manuscript placed on a reading plane and output the result as image data. A perforating unit 4 stores and retains roll-shaped stencil sheet 5 and perforates the image on the stencil sheet 5 on the basis of the image data output from the manuscript reader 3.

A drum unit 6 for printing as image-forming means disposed adjacently to the perforating unit 4 is provided with an ink-permeable peripheral wall having ink supply means in the interior thereof and rotatably driven so as to wrap the stencil sheet 5 printed at the perforating unit 4. Here, the drum unit 6 is provided with an in-drum memory 7 in which the type of the drum used for controlling the machine is stored. Further, a press unit 8 including press rollers is installed at the lower part of the drum unit 6 in an ascendable and descendable manner. The press unit 8 ascends in conformity with the moment when printing paper 9 is supplied in the gap with the drum unit 6, presses the printing paper 9 to the stencil sheet 5 of the drum unit 6, and thereby can transfer the printing paper 9 in accordance with the rotation of the drum unit 6 and apply printing to the printing paper 9.

The stencil printing machine 1 has a paper feed unit 13 including three paper feeders in total of a paper feed table 10 disposed at a side section of the casing 2 in an exposed manner, a No. 1 tray (upper) 11, and a No. 2 tray (lower) 12, both of which are disposed below the drum unit 6 and the press unit 8 in the casing 2. The three paper feeders are used selectively and supply the printing paper 9 to the drum unit 6.

Note that, in the case of the stencil printing machine 1 of the present embodiment, although it is also possible to contain different kinds and sizes of printing paper in the three paper feeders, the explanations are made on the premise that identical printing paper 9 is contained here.

Paper sensors 15 to detect the existence of the printing paper 9 are attached to the paper feed table 10, the No. 1 tray 11 (upper), and the No. 2 tray 12 (lower), respectively.

A traveling route 16 through which the printing paper 9 is fed from the paper feed table 10 to the position between the drum unit 6 and the press unit 8 is nearly straight. In contrast, a traveling route 17 through which the printing paper 9 is fed from the No. 1 tray 11 located immediately below the drum unit 6 and the press unit 8 to the position between the drum unit 6 and the press unit 8 forms a curved line of a nearly semicircular shape. Then a traveling route 18 through which the printing paper 9 is fed from the No. 2 tray 12 located below the No. 1 tray 11 to the position between the drum unit 6 and the press unit 8 forms a curved line of a nearly semicircular shape having a smaller curvature than that of the traveling route 17 leading from the No. 1 tray 11.

Jamming detection sensors 20 to detect the jamming of the printing paper 9 are disposed in the three traveling routes 16, 17, and 18 leading from the paper feed table 10, the No. 1 tray 11 (upper), and the No. 2 tray 12 (lower) to the drum unit 6, respectively.

The stencil printing machine 1 has a paper discharge unit 25 to which the printed paper 9 discharged from the drum unit 6 is discharged on the other side, opposite the side where the paper feed table 10 is placed, of the casing 2. Transfer means 26 is disposed between the drum unit 6 and the paper discharge unit 25 in the casing 2. The printing paper 9 printed and discharged from the drum unit 6 is transferred by the transfer means 26, discharged to the outside of the casing 2, and piled up in the paper discharge unit 25.

The stencil printing machine 1 has a stencil discharge unit 27 on the side opposite to the perforating unit 4 in the casing 2 in the manner of interposing the drum unit 6 in between. The stencil discharge unit 27 is a device to peel off from the drum unit 6, store in the container, and discard the used stencil sheet 5.

As shown in FIGS. 1A and 1B, the stencil printing machine 1 has an operation panel 30 on the upper surface side of the casing 2. The operation panel 30 indicates the various kinds of setting in various operations such as reading, perforating, printing, stencil discharging, and others (including the setting of automatic selection of paper feeders and switching of manual setting) and operations such as start of operation and others, and further can confirm the contents of the setting on a display.

Though it is not shown in FIGS. 1A and 1B, as shown in FIG. 2, the stencil printing machine 1 has a control unit 40 to control the whole machine including the aforementioned various components. A ROM 41 in which a control program is stored and a RAM 42 in which various kinds of set data for control, read-out image data, and others are stored are connected to the control unit 40. Further, paper feeder selection means 45 to select a paper feeder used at the time of printing from among the paper feed table 10, the No. 1 tray 11 (upper), and the No. 2 tray 12 (lower) is connected to the control unit 40. Then memory means in which data used as standard when the paper feeder selection means 45 selects a paper feeder is stored in the form of the maximum allowable printing speed table 46 as shown in FIG. 5 below is connected to the paper feeder selection means 45. Furthermore, jamming rate judging means 47 is connected to the control unit 40 and judges whether or not jamming occurs for each of the paper feeders by a predetermined method when each of the jamming detection sensors 20 detects the occurrence of jamming during the use of the machine. When jamming is detected, the jamming rate judging means 47 computes the jamming rate and stores the jamming rate as data in the memory means or the like.

In such a stencil printing machine 1 as shown in the present embodiment, it is possible to rotate the drum unit 6 at a high speed and carry out printing at the high speed. In such high speed printing, the printing speed of the drum unit 6 has to match the speed of the printing paper 9 supplied from a paper feeder to the drum unit 6. The speed of the printing paper 9 supplied from a paper feeder to the drum unit 6 (the maximum allowable printing speed of drum unit 6 for a paper feeder) here depends on the shape of the traveling route of the printing paper 9 formed between the relevant paper feeder and the drum unit 6. The paper feed speed can be increased when the traveling route is straight. When a curved portion exists therein, however, the paper feed speed has to be reduced to that extent and the paper feed speed is reduced as the curvature of the curved portion increases.

The reason why the maximum allowable printing speed differs from a paper feeder to another paper feeder is that the positional relationship between a relevant paper feeder and the drum unit 6 is different. As stated above, the traveling route 16 extending from the paper feed table 10 to the drum unit 6 is a straight line and external factors never influence the printing paper 9. In contrast, the No. 1 tray 11 is located in the vicinity immediately below the drum unit 6 and the printing paper 9 is fed in the inversed manner through the traveling route 17 having a small curvature radius. When hard and thick paper is fed, the traveling route 17 of the No. 1 tray 11 causes fold, wrinkle, or feed failure of the printing paper 9 and inconvenience occurs when the printing speed is increased. For that reason, in the case of the No. 1 tray 11, the maximum allowable printing speed has to be set at a lower level than the paper feeder having a straight traveling route such as the paper feed table 10. Further, in the case of the No. 2 tray 12, the curve of the traveling route 18 is milder (smaller in curvature) than that of the No. 1 tray 11 and hence the No. 2 tray 12 can cope with a somewhat higher printing speed.

As explained above, the traveling speeds of paper fed from the three paper feeders to the drum unit 6 in a stencil printing machine 1 according to the present embodiment are different from each other due to the difference of the shapes of the traveling routes 16, 17, and 18 of the printing paper 9. In the present embodiment therefore, the allowable paper feed speed of each of the paper feeders is stored in memory means as the maximum allowable printing speed intrinsic to each of the paper feeders in the form of a table and thus a maximum allowable printing speed table 46 is formed as shown in FIG. 5 and set as the standard which is compared with the printing speed of the drum unit 6 by the paper feeder selection means 45.

Successively, the flow on the selection of a paper feeder at the time of printing in a stencil printing machine 1 according to the present embodiment is explained in reference to FIG. 3.

A control unit 40 integrally controls the whole machine with other data including the data in the RAM 42 in accordance with the program in the POM 41, activates the paper feeder selection means 45 if necessary as it will be described later in detail, uses also the data on the maximum allowable printing speed table 46 shown in FIG. 5, and exhibits the function of selecting a paper feeder during printing as it will be described later.

Firstly, when indication of print start is given and the operation starts, the control unit 40 judges whether or not paper feeder automatic selection is set (S11). When the automatic selection is not set (NO at S11), a paper feeder is selected manually by a user by showing proper display or the like on the display unit or the like in the operation panel 30, and thus drawing a user's attention (S12). Thereafter, paper is fed from the relevant paper feeder and printed (S19) and the printing is terminated after prescribed sheets of paper are printed (S20 and S21).

When paper feeder automatic selection is set (YES at S11), whether or not the paper feed table 10 or the paper tray 11 or 12 (a paper feeder) in which paper of the size conforming to the size of the manuscript to be printed is contained exists is judged (S13). When none of the paper feeders exists (NO at S13), a necessary paper feeder is selected manually by a user by showing proper display or the like on the display unit or the like in the operation panel 30, thus drawing the user's attention, and switching the paper feeder (S12). Thereafter, paper is fed from the relevant paper feeder and printed (S19) and the printing is terminated after prescribed sheets of paper are printed (S20 and S21).

When the paper feed table 10 or the tray 11 or 12 (a paper feeder) in which paper of the size conforming to the size of the manuscript to be printed is contained exists (YES at S13), whether or not the number of such paper feeders is plural is judged (S14). When the number is not plural but singular (NO at S14), only the paper feeder is selected (S15), paper is fed from the paper feeder and printed (S19), and the printing is terminated after prescribed sheets of paper are printed (S20 and S21).

When at least two paper feeders in which paper of the size conforming to the size of the manuscript to be printed is contained exist among the paper feed table 10 and the trays 11 and 12 (paper feeders) (YES at S14), whether or not a user wants speed-priority for the printing is judged (S16). Here, when the user dares to select the setting of no speed-priority (NO at S16), a paper feeder is selected in accordance with another condition (S17). For example, an arbitrary condition is selected from among conditions such as a jamming rate, the number of contained paper sheets, and others and a paper feeder conforming to the condition is selected (S17). Thereafter, paper is fed from the relevant paper feeder and printed (S19), and the printing is terminated after prescribed sheets of paper are printed (S20 and S21).

When a user selects speed-priority (YES at S16), the control unit 40 activates the paper feeder selection means 45 and selects a paper feeder of a highest speed in reference to the maximum allowable printing speed table 46 shown in FIG. 5 (S18). Thereafter, paper is fed from the relevant paper feeder and printed (S19), and the printing is terminated after prescribed sheets of paper are printed (S20 and S21).

Here, the setting of speed-priority by a user may be either confirmed at every printing or registered in advance at initial user setting. Further, although the explanations have been made here on the premise that printing paper 9 is contained in all the paper feeders, whether or not printing paper 9 is contained is confirmed for each paper feeder under normal conditions. As a matter of course, the setting may be configured so as to confirm the existence of printing paper 9, and either issue an error when printing paper 9 is not contained or select a paper feeder from among other paper feeders containing printing paper 9.

Successively, the functions in an embodiment modified from the present embodiment are explained in reference to FIG. 4.

In the modified embodiment, in the selection of a paper feeder explained in reference to FIG. 3, when selectable paper feeders exist in plurality (when candidate paper feeders exist in plurality) in particular, a paper feeder is selected from among the plural paper feeders on the basis of the level of the jamming rate. Consequently, the same codes as shown in FIG. 3 are put to the processes having the same contents as FIG. 3 and the explanations thereof are omitted, and only the parts different from FIG. 3 are explained mainly.

In FIG. 4, in the case where the paper feeder selection means 45 selects an optimum paper feeder in reference to the maximum allowable printing speed table 46 shown in FIG. 5 (S18), when the number of the relevant paper feeder is only one (NO at S30), only the paper feeder selected in reference to the maximum allowable printing speed table 46 is selected (S31) and, when the number of the paper feeders having the same maximum allowable printing speed is plural (YES at S30), the paper feeder of the lowest jamming rate (S32) is selected. Thereafter, paper is fed from the relevant paper feeder and printed (S19), and the printing is terminated after prescribed sheets of paper are printed (S20 and S21).

Successively, yet another modified embodiment is explained in reference to FIG. 6.

This is a first example in the case where a printing speed is restricted.

Presumable examples are the case where post-treatment (stapling or punching) is applied and the case where both side printing is carried out when the present invention is applied to a both side printing machine. In those cases, the printing speed is restricted regardless of a user's request. That is, the printing speed has to be lower than a prescribed image-forming speed in order to apply special post-treatment or the like and an appropriate paper feeder must be selected within the range where the upper limit is determined.

In such a case as the present modified embodiment, there is the possibility that paper feeders having maximum allowable printing speeds higher than the restricted printing speed exist in plurality. In such a case, a paper feeder of a lower jamming rate is selected from among the paper feeders having the maximum allowable printing speeds higher than the restricted printing speed.

A user selects "speed-priority." When post-treatment or both side printing is set as stated above however, "restriction of speed" is applied from the mechanical side. In the case where the speed is limited to the maximum of 120 rpm for example, when there are four paper feed trays (1) to (4) as shown in FIG. 6, the selectable paper feed trays are the three paper feed trays (1) to (3). However, even though any of the three trays is selected, the speed is restricted to 120 rpm. Hence in the present modified embodiment, a paper feed tray is selected by giving priority to a jamming rate and thus the paper feed tray (3) (jamming rate: 0.2%) having the lowest jamming rate is selected from among the three paper feed trays.

Successively, yet another modified embodiment is explained in reference to FIG. 7.

This is a second example in the case where a printing speed is restricted.

In the case of the present modified embodiment, when paper feeders having maximum allowable printing speeds higher than the printing speeds restricted by printing conditions exist in plurality, the paper feed tray having the highest maximum allowable printing speed is selected from among the paper feeders having the maximum allowable printing speeds higher than the restricted printing speeds.

A user selects "speed-priority." When post-treatment or both side printing is set as stated above however, "restriction of speed" is applied from the mechanical side. In the case where the speed is limited to the maximum of 120 rpm for example, when there are four paper feed trays (1) to (4) as shown in FIG. 7, the selectable paper feed trays are the three paper feed trays (1) to (3). However, even though any of the three trays is selected, the speed is restricted to 120 rpm. Moreover, when no difference is found even in reference to another condition (a jamming rate) (the jamming rate of the three trays is 0.2% in the present modified embodiment), the paper feed tray (1) having the highest maximum allowable printing speed is selected. The reason is that the traveling route of the paper feed tray having the highest maximum allowable printing speed is flatter than the traveling routes of other paper feed trays and hence the possibility that slip of paper may be affected cannot be denied even when the jamming rate is identical.

A stencil printing machine is exemplified as a high-speed image-forming machine wherein the effects of the present invention are particularly conspicuous in the above embodiments. However, similar effects can be obtained also with a printing machine of another principle. Further, even when the present invention is applied to an image-forming machine other than a printing machine, the effects conforming to the magnitude of the image-forming speed can be obtained.

What is claimed is:

1. An image-forming machine, comprising:

an image forming device for printing sheets;

a plurality of paper feeders for supplying the sheets to the image forming device;

a plurality of traveling routes extending from the respective paper feeders toward the image forming device, said traveling routes associating with the paper feeders and having predetermined paper feeding speeds depending on a curvature radius thereof, respectively;

a paper feeder selection unit for selecting one of the paper feeders performing a highest maximum allowable image-forming speed set based on the paper feeders;

a control unit electrically connected with the image forming device, the paper feeders, and the paper feeder selection unit, for controlling the image forming device, the paper feeders, and the paper feeder selection unit, said control unit having a setting of speed-priority; and an operation panel indicating settings of operations manually selectable by a user of the image-forming machine, wherein when the user selects the setting of speed-priority on the operation panel, the paper feeder selection unit selects the paper feeder of the highest maximum allowable image-forming speed and operates the image forming device according thereto.

2. The image-forming machine according to claim 1, further comprising a memory unit electrically connected with the paper feeder selection unit, wherein the maximum allowable image-forming speed is stored in the memory unit.

3. The image-forming machine according to claim 1, wherein the control unit is configured to judge whether or not a paper feeder automatic selection is set when an indication of print start is given and an operation starts, whether or not at least one paper feeder containing the sheets conforming to a size to be printed exist when the paper feeder automatic selection is set, and whether or not the paper feeder selected by the user is plural when the at least one paper feeder exists.

4. The image-forming machine according to claim 1, wherein the plurality of paper feeders includes a first paper feeder having a traveling route extending substantially horizontally to provide the highest maximum allowable image-forming speed, and second and third paper feeders located under the image forming device and having curved traveling routes to provide an image-forming speed less than the highest maximum allowable image-forming speed.

* * * * *